US007959793B2

(12) United States Patent
Bakshi

(10) Patent No.: US 7,959,793 B2
(45) Date of Patent: Jun. 14, 2011

(54) OPTIMUM PROCESS FOR SELECTIVE HYDROGENATION/HYDRO-ISOMERIZATION, AROMATIC SATURATION, GASOLINE, KEROSENE AND DIESEL/DISTILLATE DESULFURIZATION (HDS). RHT-HYDROGENATIONSM, RHT-HDSSM

(76) Inventor: Amarjit Singh Bakshi, Katy, TX (US)

( * ) Notice: Subject to any disclaimer, the term of this patent is extended or adjusted under 35 U.S.C. 154(b) by 1266 days.

(21) Appl. No.: 11/527,819

(22) Filed: Sep. 27, 2006

(65) Prior Publication Data

US 2008/0073250 A1 Mar. 27, 2008

(51) Int. Cl.
*C10G 45/04* (2006.01)
*C10G 45/32* (2006.01)

(52) U.S. Cl. ..... 208/209; 208/208 R; 208/211; 208/213; 585/259; 585/260

(58) Field of Classification Search ..... None
See application file for complete search history.

(56) References Cited

U.S. PATENT DOCUMENTS

| | | | | |
|---|---|---|---|---|
| 5,597,476 | A * | 1/1997 | Hearn et al. | 208/208 R |
| 6,676,830 | B1 * | 1/2004 | Vichailak et al. | 208/210 |
| 7,090,766 | B2 * | 8/2006 | Johnson et al. | 208/210 |
| 2001/0050245 | A1 * | 12/2001 | Hearn et al. | 208/189 |
| 2003/0094399 | A1 * | 5/2003 | Podrebarac | 208/210 |
| 2003/0230516 | A1 * | 12/2003 | Johnson et al. | 208/208 R |
| 2004/0000506 | A1 * | 1/2004 | Podrebarac et al. | 208/211 |
| 2004/0040889 | A1 * | 3/2004 | Groten | 208/210 |
| 2004/0195151 | A1 * | 10/2004 | Podrebarac et al. | 208/210 |
| 2005/0082201 | A1 * | 4/2005 | Groten et al. | 208/211 |

* cited by examiner

*Primary Examiner* — Tam M Nguyen

(57) ABSTRACT

A process for selective hydrogenation of $C_3/C_4/C_5/C_6/C_7$ and LCN, hydro-isomerization of olefins, benzene saturation and hydrodesulfurization of Gasoline, Kerosene and Diesel together with aromatic saturation of LCO is being provided so as to provide optimum technology at low cost with unique configuration. The technology is user friendly and uses conventional catalyst. These configurations cover both the options of installing the bulk catalyst in the distillation column with chimneys trays, hence essentially all the reaction takes place in the liquid phase in single or multiple beds or with fixed bed down flow or up flow reactor configuration. The configurations shown in the figures depicts that the fixed bed reactors are integrated with the Distillation Column and this art helps in lowering the Capital costs and the reactors are operating in single phase or two-phase conditions. The art is applicable to MAPD, vinyl acetylene, $C_3$, $C_4$, $C_5$, $C_6$, $C_7$ mixed hydrocarbon stream, and LCN diolefin selective hydrogenation. It includes the process for hydro-isomerization of Butene-2 to Butene-1, or visa versa, removal of Isobutylene and Isobutane by distillation after hydro isomerization, benzene hydrogenation to Cyclohexane, hydrodesulfurization of FCC gasoline, coker gasoline or any other Naphtha stream together with hydrodesulfurization of Diesel/Kerosene from any of the refinery units.

2 Claims, 7 Drawing Sheets

Figure I
RHT FCC Gasoline Hydrogenation

Note 1. The Feed can be $C_3$ to $C_7$ stream which needs tobe selectively hydrogenated.

RHT Steam Cracker Naphtha Hydrogenation

RHT Hydrogenation: MAPD, Acetylenes, $C_3$, $C_4$, $C_5$, LCN SHU/HDS, Benzene Saturation & Alpha to Beta ISOM

RHT Hydrogenation: MAPD, Acetylenes, $C_3$, $C_4$, $C_5$, LCN SHU/HDS, Benzene Saturation & Alpha to Beta ISOM

RHT Hydrogenation: MAPD, Acetylenes, $C_3$, $C_4$, $C_5$, LCN SHU/HDS, Benzene Saturation & Alpha to Beta Isom Item 6, Option to have a Catalyst bed withoutside vapor bypasss, No chimney's for vapor through the bed.

RHT FCC Gasoline HDS

RHT FCC Gasoline HDS

OPTIMUM PROCESS FOR SELECTIVE HYDROGENATION/HYDRO-ISOMERIZATION, AROMATIC SATURATION, GASOLINE, KEROSENE AND DIESEL/DISTILLATE DESULFURIZATION (HDS). RHT-HYDROGENATIONSM, RHT-HDSSM

FIELD OF THE INVENTION

The inventions and the arts here in the following processes is selective hydrogenation of Acetylene, MAPD, $C_3/C_4/C_5/C_6/C_7$ and LCN, Hydro-isomerization, Benzene saturation and hydrodesulfurization of Gasoline, Kerosene and Diesel/Distillate in a unique and optimized configuration and selection of multiple catalysts so as to provide low cost processes and maximizing yields compared to Conventional processes. RHT process is enhanced configuration compared to process with simultaneous reaction and distillation which uses the high cost catalyst and is cumbersome to load in the equipment, together other potential drawbacks as Reaction conditions are not normally consistent with fractionation which provides a non optimum option. This Reactive distillation technology also requires much higher energy due to reflux requirements for the column. The present art of RHT process provides an alternate to conventional technology and Reactive distillation that is being applied for Selective Hydrogenation, Benzene Saturation and Gasoline HDS applications. In Benzene Saturation and Gasoline HDS applications it is not logical to use the Reactive Distillation as it increases the Capital cost due to high temperature energy source for benzene saturation, which might require a Furnace. In the case of Gasoline HDS, Reactive distillation, requires the reflux for the column, and to enhance the WABT of the catalyst zone (at operating pressure) most of the product is taken overhead, (essentially column working in a recycle mode), which doubles the energy requirements of the process (Licenser's U.S. Pat. No. 6,495,030). This is an expensive alternative, when energy costs are 75 $/bbl of oil, though heat integration can improve the energy utilization but still will have to lose lot of the hot energy to waste. RHT technologies apart from providing unique optimized configurations by providing alternate reaction and distillation in the column by installing bulk catalyst in the column or outside in the side reactors, provides one unit operation in the single equipment or alternate integrating fixed bed reactors to the Column as side reactor and are capable of operating in down flow or up flow mode, which ever gives better economics for particular application. Reactor and Distillation column are operated at best operating conditions suitable for each unit operation rather than sacrificing the economics for Reactive distillation on the basis of higher catalyst life, which can be achieved by removing the diolefins from the feed and operating the reactor in two phase flow operation. RHT provides the concept in this art, with reactions and separation done at most favorable conditions and not to install high cost and cumbersome catalyst in the column providing a mirage that the economics is better. The FIGS. 1, 2,3,4 and 5 provide the optimum configurations for different applications for selective hydrogenation and mild HDS, and are the basis of the art used in this invention. A unique technique for vapor bypassing the catalyst is proposed for reactive distillation equivalent, providing alternate reaction and distillation steps rather than simultaneous reaction and distillation. RHT process in FIG. 5, suggests multiple bed catalyst system with chimney trays or by external pipe. The bulk catalyst could be any of the catalysts from the periodic table mostly from the group VIB, VIIIB. The small amount of the catalyst can be installed in the stabilizer if so desired to get an extra reaction stage. The most likely catalysts used are Pd/Ag, Ni, Ni/Mo etc., on Silica or Alumina base (but not limited to these bases or catalysts). The unique capability of the Gasoline HDS process providing selective process with low octane loss is shown in FIGS. 6 and 7 where LCN is maximized in the Gasoline Splitter by selectively hydrogenating the diolefins and removing the lighter non-refractory sulfur. The heavier fractions like Kerosene and Diesel the FIG. 8 provides a concept of multiple catalysts in the reactor and also the unique configuration so that the feeds can be taken hot directly from the source. In this respect the feed to the reactor can be taken directly from the Crude/Vacuum Column pump-around or side draws, main Fractionator/Coker side draws and fed to the reactors without cooling. This can also be provided as staged reactors for these streams so as to cascade the $H_2$ from one reactor to the other. This unique configuration provides capability to revamp any unit with very small modifications and reducing the energy and catalyst cost by a factor of 2 to 3 times respectively.

The technology and the art of RHT provides process for mercaptan removal from FCC Naphtha (FIG. 1), selective hydrogenation of Steam Cracker Naphtha (FIG. 2) FCC gasoline HDS at low cost and low octane loss (FIGS. 6 and 7). Other configurations for selective hydrogenation $C_3$, $C_4$, $C_5$, $C_6$, and C, and aromatic saturation, unique configuration for $C_4$ olefin isomerization (FIGS. 3,4, and 5), which provides better yield/selectivity at low cost compared to conventional and reactive distillation technology. The cost is much lower than conventional technologies or reactive distillation technology. For the process where equilibrium conditions at the outlet of the catalyst zone are obtained, reactive distillation is less than optimum thermodynamically especially for isomerization of close boiling components. The unique side reactor concept provides the equilibrium isomerization conditions at the reactor outlet and the feed to reactor is taken where maximum amount of unwanted species is available in the distillation column. The Reactive distillation technology suffers from single source catalyst; cost much higher than conventional catalyst, higher utilities and cumbersome catalyst installation. The side reactor concept can be paid off in 6 to 12 months maximum as compared to expensive catalyst cost. Some of the other technologies are coming up with baffles/a channel, where better mass transfer is claimed which enhances the reaction. The advantage claimed is about 20% in cost, but the cost of baffles/channels (catalyst installation in channels) is cumbersome and revamp for expansion could be much more complicated and expensive, similar to Reactive distillation.

BACKGROUND OF THE INVENTION

Following typical Catalyst applications are being proposed: for selective hydrogenation, Isomerization, aromatic saturation and Hydrodesulfurization of Gasoline, kerosene and Diesel/distillates. The invention's advantages can be easily seen by people familiar in art and the merits of different catalyst for different applications but are not limited to these catalysts only. The art also allows the user to switch catalyst based on the availability in the market place if some new catalyst comes to the market; the information provided here is just for illustration. The processes/configurations use different catalyst for Selective Hydrogenation and isomerization, hydrodesulfurization, aromatic saturation and also for desulfurization of cracked and straight run Feeds as shown below.

Following catalyst is used for the services proposed in this invention and are not limited to these and can use any commercial available catalyst for the service. The unique and superior configuration provides advantages in selectivity, low cost of catalyst and utilities. Cost of extra equipment is paid up in 6 to 12 months depending on service compared to some technologies which claim lower capital cost. The other advantages of selectivity/Low Octane loss, low energy has been not taken into account for this patent economics as regards to payout period for extra equipment. This essentially means that after taking all the benefits there are major advantages provided by this configuration.

| SELECTIVE Hydrogenation | |
|---|---|
| Vinyl acetylene | Ni, Ni/W, Ni/Mo, Pd/Ag, Pd/Pt etc. |
| MAPD | Pd, Pd/Ag, Pd/Pt, Ni, Ni/Mo, Ni/W etc. |
| $C_4/C_5/C_6/C_7$ and LCN or FRCN, | Ni, Pd, |
| Diolefin/Sulfur removal application: | Ni/Mo, Ni/W, Co/Mo etc. |
| Isomerization; Alpha to Beta Isomerization | |
| C4/C5/C6 and LCN | Pd, Pd/Pt, Pd/Ag, Ni, Ni/Mo and Ni/W. |
| Aromatic Hydrogenation | |
| Benzene Saturation | Ni, Pt on Zeolite etc |
| Hydrodesulfurization | |
| Gasoline HDS | Ni, Ni/Mo, Co/Mo, Ni/W etc. |
| Kerosine | Ni/Mo, Co/Mo, Ni/W etc. |
| Diesel/Distillate | Ni/Mo, Co/Mo, Ni/W etc |
| LCO for Cetane improvement | Zeolite/Pt |

As mentioned above that the catalyst could be bulk catalyst from any of the above catalysts but one is not limited to these catalyst only for all the above processes and would chose what ever best catalyst is available in the market. The bulk catalyst in the column or in the side reactors provides high catalyst efficiency and usage and lower catalyst cost and better yield/selectivity and also low utility consumption. There is not much of an advantage of having the catalyst in packaging (which is usually is cumbersome to install/loading) in the column and simultaneous reaction and distillation, except few processes where rate constants are high but that can also be compensated by unique RHT configuration as explained in this and other patents (U.S. Pat. No. 4,503,265). In most of the applications the reaction and distillation operating conditions are not optimum for each unit operation. By artificial means of increasing the certain parameters to make the process workable in this application provides the solution which are not cost effective due much higher and catalyst and operation being at not optimum conditions. RHT provides the application and configuration, with bulk catalyst where both distillation and reaction can be essentially decoupled and run at optimum conditions, but still integrated with the column so as to save the cost. The bulk catalyst in the column or in side reactors attached to column can be loaded above and below the feed location but preferably above the feed location. In some applications the fixed bed reactor can also be installed upstream of the column as shown in the FIGS. 1, 6 and 7. Unless the reaction is very fast and feed rates are small, (specialty chemical application, small equipment), the packaged catalyst and catalyst in baffles/channels could be cumbersome to install through the man way, and is not normal plant design which is convenient and also does not provide the best economics.

Gasoline hydrodesulfurization by Reactive distillation, as per the (U.S. Pat. No. 6,495,030) ICN is taken overhead and is being claimed that that the partial pressure of olefins and $H_2S$ is lower hence mercaptan sulfur in the product. On the contrary in Reactive Distillation technology, equilibrium conditions are much favorable at the top to make mercaptan sulfur as the partial pressure of olefins and $H_2S$ is highest at the top and also the temperature is lower which favors mercaptan formation. It seems by taking ICN overhead the catalyst bed temperature (WABT) is increased artificially by taking most of the product overhead, this provides temperature required for desulfurization. Though it does the job but at about 1.5 to 2.0 times energy consumption of the conventional process. The Reactive distillation HDS process can heat integrate which makes the unit complex/unstable in operation and by nature the reflux and still energy wastage adds to the energy costs. The catalyst life can be enhanced by running the reactor in two-phase operation rather than vapor phase operation or by selectively hydrogenating the diolefins upstream as suggested in FIGS. 6 and 7.

SUMMARY OF THE INVENTION

The art of this application is applicable to following processes. RHT-Hydrogenation$^{SM}$, RHT-HDS$^{SM}$.

Selective Hydrogenation of Vinyl acetylene, methyl acetylene/propadiene, butadiene, isoprene, pentadienes, hexadiens etc. and other diolefins in hydrocarbon streams from FCC, Steam Cracker, Thermal Crackers (e.g. Visbreaker and delayed Cokers etc.) are reduced by this application to 5 wppm to 1000 wppm in the product as per the requirements of the process. The conditions for Operating the reactor will depend on each species and will have Ni, Pd, Pd/Pt. Pd/Ag, Ni/Mo or Ni/W catalyst but not limited to, and having stoichiometric amount of hydrogen to about 200 Scf/bbl of Feed, preferably around 50 to Scf/bbl of Feed. The temperature range will be in 100 F to 400 F, but depending on the Feed composition and catalyst type, temperature of around 100 F to 300 F is used. The pressure range will be in 75 psig to 400 psig, but preferably in the range of 150 to 300 psig. In most of the cases the fractionator could be operated at lowest pressure so as to condense the overhead product. The pressures/temperatures ranges are provided for the selective hydrogenation reactor applications as shown in the FIGS. 1,2, 3, 4 and 5.

Isomerization can be done with Pd, Pd/Pt, Ni or Ni/Mo catalyst but not limited to these catalysts, based on the Feed characteristics and for most of the applications temperature could be in the range of 100 to 300 F, similar operating conditions required for Selective hydrogenation (SHU), unit as mentioned above. This is shown in FIGS. 3, 4 and 5.

Aromatic Saturation/hydrogenation, this can be done with Ni or Pt/Zeolite catalyst depending on the impurities and ultimate specification. For Ni one need to be careful with Feed impurities, as stated in the literature and well described in the art that sulfur in the feed should be less than 1 wppm as it poisons the catalyst (though reformate product has no sulfur unless contamination due to storage etc.) for aromatic saturation. To meet the gasoline specification for the Benzene content or mixed stream where some of the Benzene is to be only saturated, than one will use a low pressure splitter to take a side draw Benzene concentrate or taken overhead and feed it to the reactor for benzene conversion to cyclohexane. If there are other lighter components in the feed, this provides an optimum condition for separation and hydrogenation rather than doing both unit operations in one equipment practiced by Reactive distillation. Reactive distillation provides non optimum conditions and requires high temperature boiling medium for the column reboiler, and on the whole the economics is not that good due to obvious reasons of catalyst cost and also process is not flexible, has to use single source packaged catalyst. The configuration is shown in FIGS. 3,4 and 5 are applicable for Benzene saturation and selective hydrogenation application as well.

Hydro-desulfurization of Gasoline/Kerosine and Diesel/Distillate: FIGS. 6, 7 and 8, provide the RHT configurations for these applications. Additional comments are provided together with claims in the write up later. The art of each application is understood by the Figures and detail description of the figures. In the gasoline pool, most of the sulfur over 90% comes from the FCC gasoline. People familiar with the automotive fuels gasoline blend stocks, know that the Isomerate, Reformate, Alkylate have essentially no sulfur in it and are the other blendstocks apart from FCC gasoline. The bulk of the gasoline pool is FCC gasoline (30 to 70%) depending on the refinery complexity. This FCC gasoline stream has the major sulfur, and is desulfurized to meet the gasoline pool sulfur specification. RHT provides a simple configuration with conventional catalysts so as to provide the optimum utilization of Catalyst for each step and the process achieves the highest selectivity with low octane loss and low capital cost. The similar configurations are provided for Kerosene and Diesel/Distillate desulfurization. The catalysts used in this application are Co/Mo, Ni/Mo, Ni/W, and Zeolite with Pt. The zeolite/Pt catalyst is used for ring opening and saturation of the aromatics in LCO or any distillate stream that has high aromatics, after desulfurization so as to improve the Cetane number of LCO product.

RHT technology has differentiated itself from the existing conventional Fixed bed technologies by having the reactor installed as a side reactor so that the capital cost can be reduced by eliminating some of the equipment from the configuration and selecting multiple catalyst to enhance the catalyst productivity, optimum operating conditions and best utilization of catalyst. RHT has reduced the operating pressures compared to conventional technologies, which has a direct effect on the capital cost reduction. RHT has also removed major drawbacks of the reactive distillation technology, by operating the reaction and distillation at their respective optimum conditions. Reactive distillation has to increase the operating pressure for LCN recovery, which is not good for distillation, as the fractionation is not done at the optimum conditions. In HCN desulfurization Reactive distillation has taken most of the product overhead (rather than increasing the pressure) as mentioned in licenser's patent (U.S. Pat. No. 6,495,030), so as to increase the WABT of the catalyst zone required for HDS. Apart from having proprietary catalyst, taking most of the product overhead, one also needs to provide reflux for reactive distillation that increases the energy for this application by a factor. If one takes most of the product overhead in gasoline HDS application, the configuration becomes complex, energy costs are doubled which one can mitigate by heat integration to some degree, but unit needs much attention in operation compared to simple Fixed bed unit or RHT configuration which is a variation of Fixed bed configuration. These things are quite obvious and as regards to catalyst life in most of the operations can be the same if the reactor is designed in two phase operation or the feed has been selectively hydrogenated in the upstream equipment as shown in FIGS. 6 and 7, and is claimed by RHT technology. The catalyst volume required in a column has got to be much higher if so much of vapor is going overhead. With the energy costs, being what they are based on oil price of 75 $/bbl, it is really not in the interest of technology advancement to waste energy and should evaluate high-energy technologies with caution. I hope Client's are able to find these pitfalls. As mentioned above that some of the energy can be heat integrated but still some of high temperature streams cannot be used to recover this energy. RHT provides the technologies, which provides the distillation at the optimum conditions and successive reaction stages at their optimum conditions, which is best configuration from all aspects. In the other areas, the unique configuration provides the advantages that will be described in the section where description of the drawings is provided. FIG. 8 provides the capability of the unit for LCO upgrading after desulfurization, by ring opening and saturating of the aromatics to naphthenes that improves the cetane number of LCO.

In general as mentioned earlier the Fixed bed reactors would operate in single or two phase operation with certain amount of vapor at inlet or outlet as required by the design requirements. The reactors are designed to operate in upflow or downflow mode in Fixed bed operation mode.

DETAILED DESCRIPTION OF THE INVENTION

Figure 1:
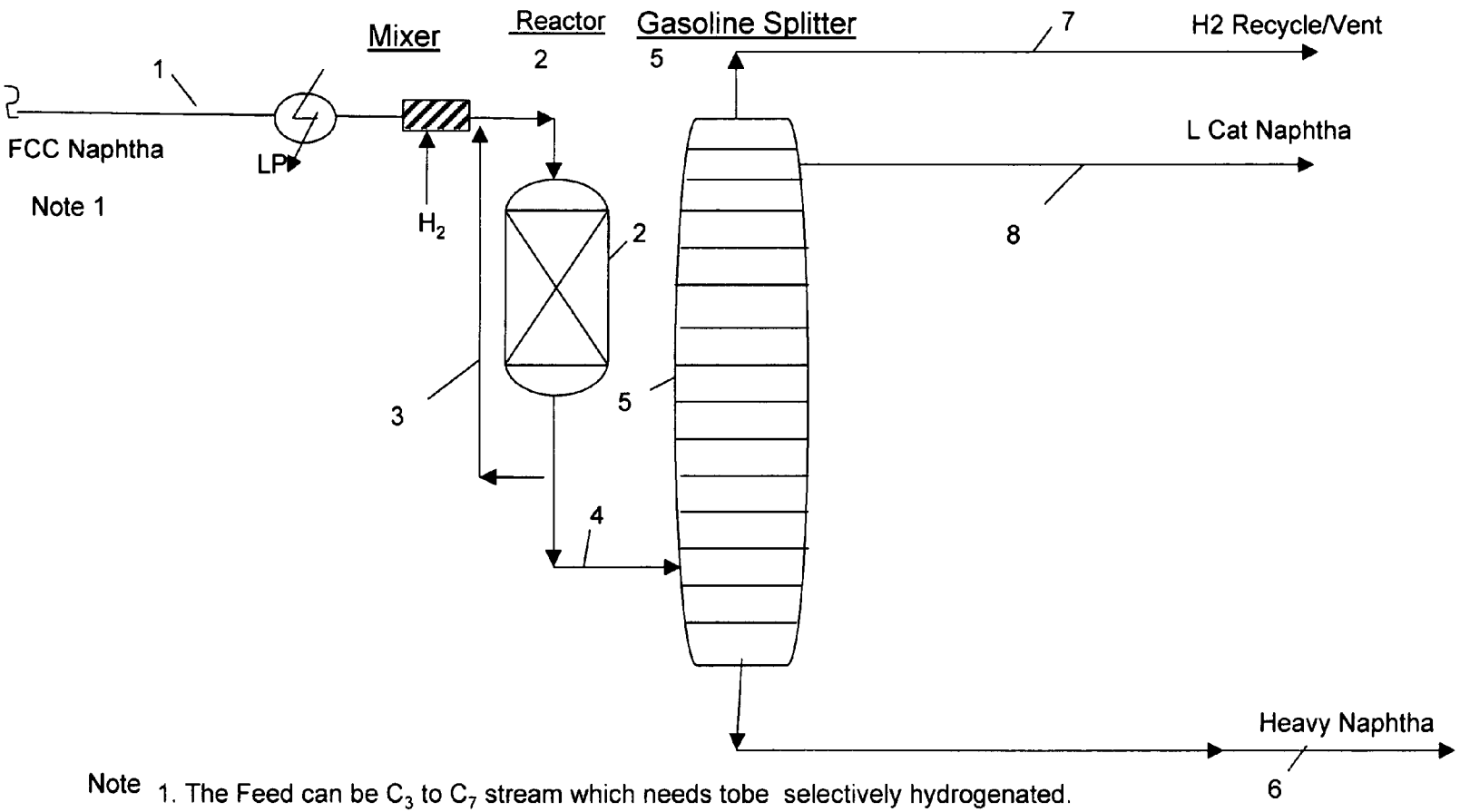
FIG. 1 is a simplified flow diagram for an embodiment for treating an FCC LC.

The FIG. 1 provides the configuration for FCC LCN, but can be used for other applications also, for $C_4$ to $C_7$ Stream, diolefins selective hydrogenation or mild HDS of LCN. The FCC Naphtha Feed stream 1, is heated to 200 to 500 F (preferably to 350 to 475 F depending on application) and pressure of 200 to 400 psig (preferable 250 psig). Stream 1, is mixed with hydrogen, (30 to 100 Scf/bbl), and reactor item 2 is operated in two phase or single-phase mode as required by the process requirements. This Feed stream after addition of hydrogen, is mixed with cold recycle stream 3, so as to provide heat sink for the heat of reaction. This mixed stream is fed to the selective hydrogenation/HDS reactor item 2 that has one of the catalysts from Ni, Ni/Mo or Ni/W, Pd, Pd/Pt (preferably Ni/Mo). Under these conditions, selectively hydrogenation of diolefins, some of the alpha to beta isomerization and also convert the mercaptan sulfur to heavier sulfur or desulfurization can be performed in this reaction and the reactor item 2 effluent stream 4 is fed to Gasoline Splitter/distillation column item 5. If mild HDS is done than one is able to take much more of the LCN overhead stream 8 and vent is taken as lights and hydrogen stream 7, so as to recover maximum olefins. This approach of Naphtha desulfurization will help in reducing the over all octane loss for FCC gasoline stream. Though there will be small octane loss at high space velocity for LCN, as all the $C_5$, $C_6$ and some off the $C_7$ can be taken overhead and meet the LCN specification of 10 wppm. For this reaction, LCN HDS at the temperature of 475 F, at a space velocity of 20 to 5 (preferably in the range of 5 to 15) to meet the LCN specification, upstream of gasoline splitter maximizing the overhead LCN volume improves the flexibility and reduces the octane loss. The Heavy Cat Naphtha stream 6 is left with lower olefin content and has the maximum sulfur content, which is taken as bottom product from the distillation column. This stream needs severe HDS conditions, and with lower olefins overall Octane loss is reduced by this configuration. RHT differentiates itself with art in providing the low cost unit. The technology is user friendly, has low catalyst and Octane loss for the FCC naphtha through HDS unit. Based on the above concept and logic and thermodynamics this provides the technology of choice for refiners. This configuration can be applied to other streams with different catalyst application/utilization and process requirements i.e. for selective hydrogenation (SHU). For selective hydrogenation operation, the conventional technologies have been operating at high pressures so as to run the reactor in single-phase operation by dissolving the hydrogen in the feed stream. The reacted stream 4 is sent the Gasoline Splitter, where LCN is taken as stream 8 and HCN is taken as stream 6. The column operates at low pressure so as to condense the LCN (or other streams like $C_4$ etc.) using normal utility conditions.

Figure 2:
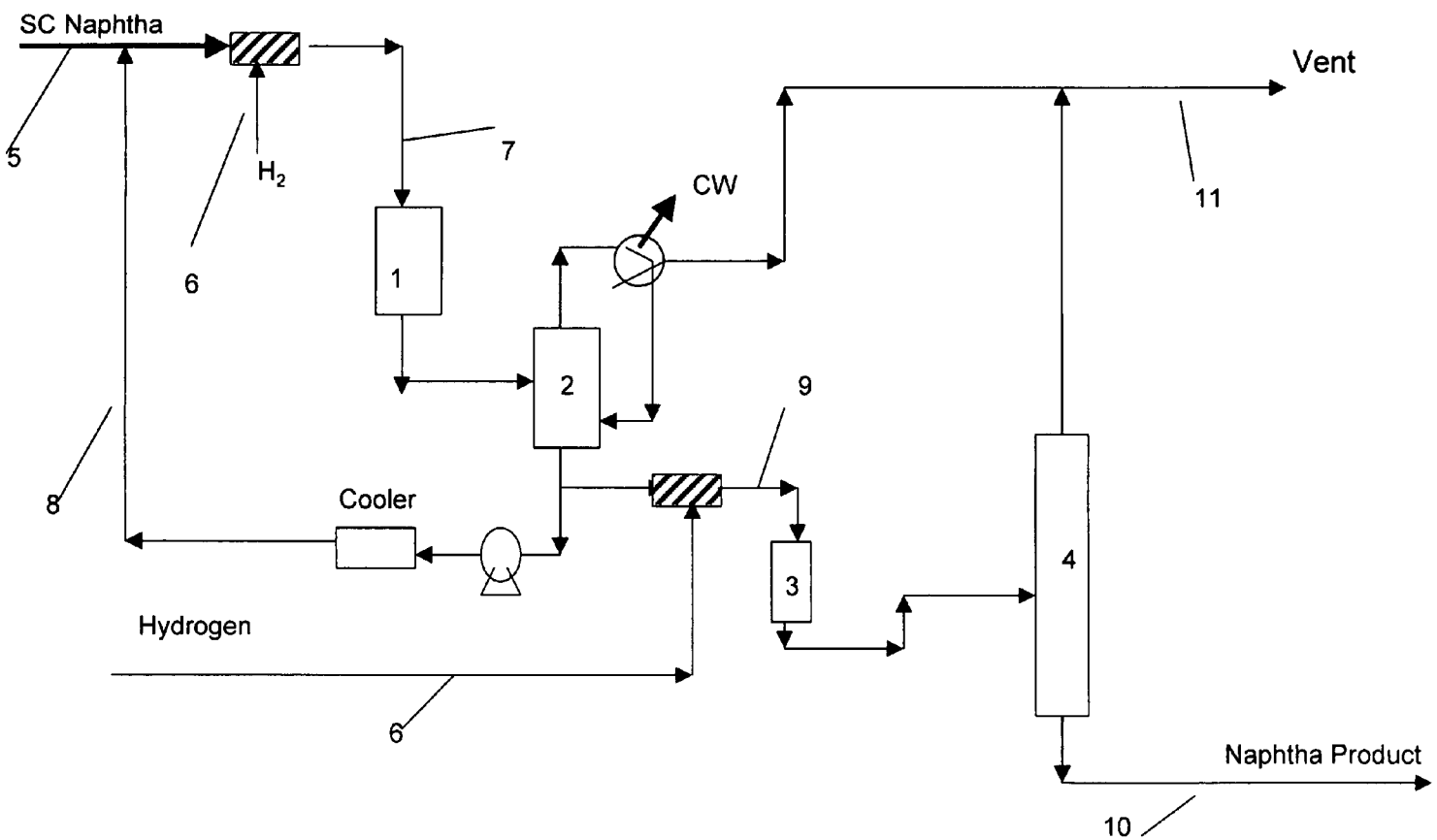
FIG. 2 is a simplified flow diagram for an embodiment specific to high concentration diolefin feeds.

The application shown in FIG. 2, is specific to high concentration diolefin feeds, Steam cracker Naphtha or Mixed C4 Streams from Steam cracker or other thermal crackers. The configuration can also be used to meet low product specification with high selectivity for any stream especially Butene-1 recovery from mixed $C_4$ Stream from stream cracker or any stream which have to be hydrogenated. This configuration provides the low diolefin specification in the product as required especially by chemical use for Butene-1 for copolymer, Butene-2 for SBA or metathesis to produce propylene. Based on the this application, FIG. 1, the feed Stream 5 is mixed with cold recycle stream 8 so as to remove the heat of reaction, and also dilutes the feed diolefin content to low level of about 4 to 5% from 45 to 50%. The hydrogen stream 6 (slightly excess, 10 to 20% above the stoichiometric requirements) is mixed with the feed stream 5 and after mixed with stream 8, its, the total mixed stream 7 is heated to reaction temperature and is fed to the reactor item 1. The reactor is operated at 100 to 300 F and 150 to 400 psig (preferably in 200 psig range), with a space velocity of 3 to 6 (preferably 5) and dioefins (butadiene) are hydrogenated to olefin (butene-1) from 45% to 1 to 2% or less in the first reactor as required by the process selectivity. The reactor effluent stream is flashed in item 2 (K.O. Drum) and part of the liquid stream 9 is sent to finishing reactor item 3, after it is mixed with hydrogen stream 6. Finishing reactor item 3 reduces the diolefins to less than 10 wppm or lower in steam 10 based on the product requirements. The product from the Finishing Reactor item 3, is sent to stabilized and taken as bottom product stream 10 from the stripper item 4, and overhead product is taken as a vent and is combined from the flash drum item 2, vent and is taken as stream 11 and is sent to fuel gas system or hydrogen recovery. This configuration is applicable for Mixed C4 Stream from the Steam cracker, using Pd, Pd/Pt, Pd/Ag, Stabilized Pd or Ni catalyst. The catalysts are not limited to these catalysts and any other suitable catalyst if available can be used. This is also applicable to the Steam Cracker Naphtha, where the first reactor saturates the diolefins (butadienes) in the presence of Pd, Pd/Pt, Ni or Ni/Mo catalyst, and the second reactor can be used for HDS of the stream so as to meet the product specification. The second reactor will need a furnace to have the desulfurization temperature similar to FIG. 6 or 7. The reactor will operate at 250 to 500 psig and 500 to 600 F temperature ranges to desulfurize the Steam cracker Naphtha. The space velocity for the first reactor item 1 will be still in the same range (WHSV 2 to 5), but for the second reactor item 3 will have a space velocity of 3 to 6 and will depend on the sulfur content and species. The Catalyst for reactor item 3 is expected to be Co/Mo, Ni/Mo or Ni/W, for HDS alternately Pd, Pd/Pt or Ni, Ni/Mo for selective hydrogenation of diolefins, and olefin hydrogenation or combination of any of these catalysts. The art is not limited to these catalysts, depending on the requirements of the process, and feed composition any catalyst already mentioned or any other new catalyst available in the market can also be used, to meet the product specification with most reactive catalyst.

Figure 3:
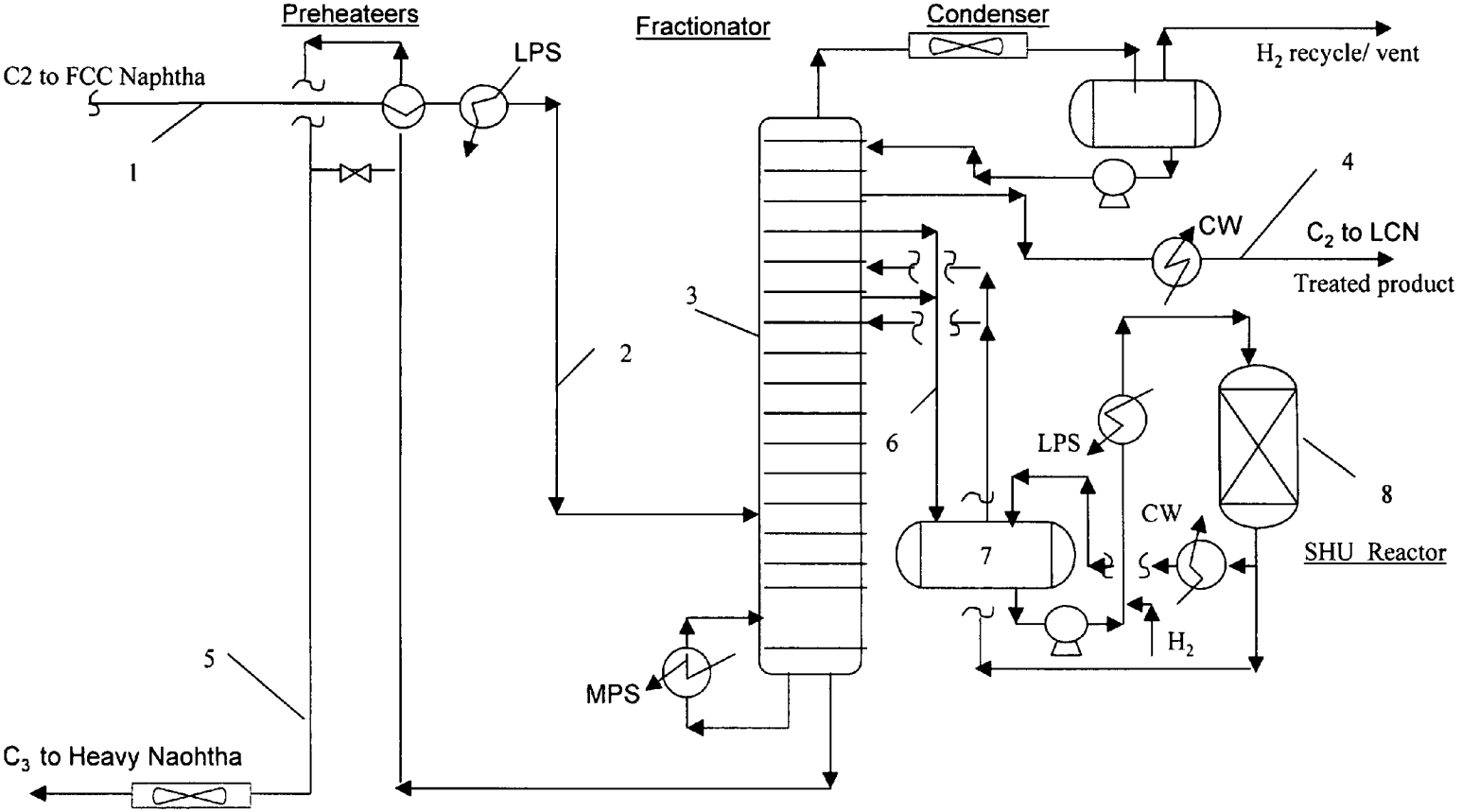
FIG. 3 is a simplified flow diagram for a first embodiment applied essentially for $C_3$ to C, hydrocarbons.
Figure 4:
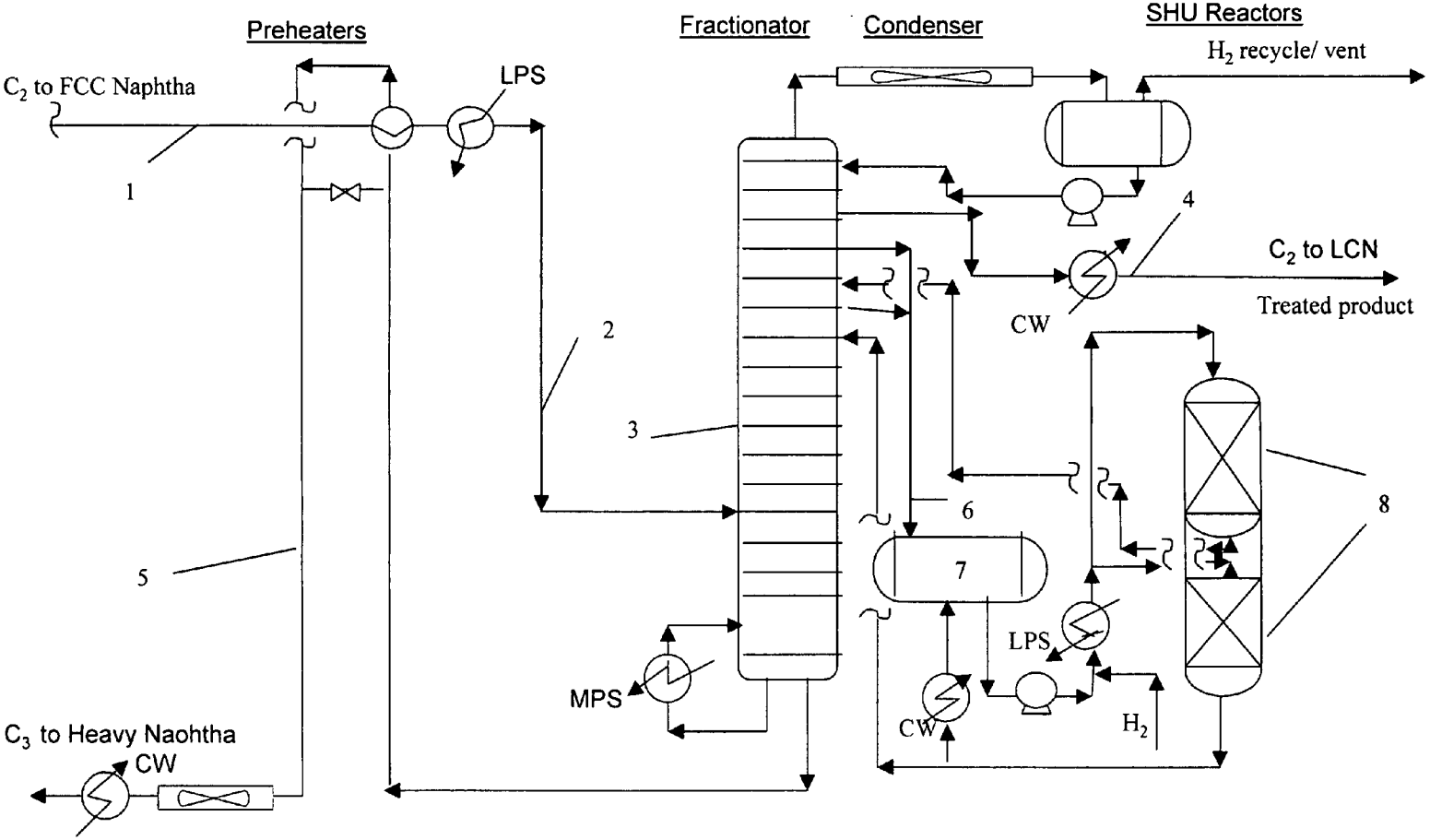
FIG. 4 is a simplified flow diagram for a second embodiment applied essentially for $C_3$ to $C_7$ hydrocarbons.
Figure 5:
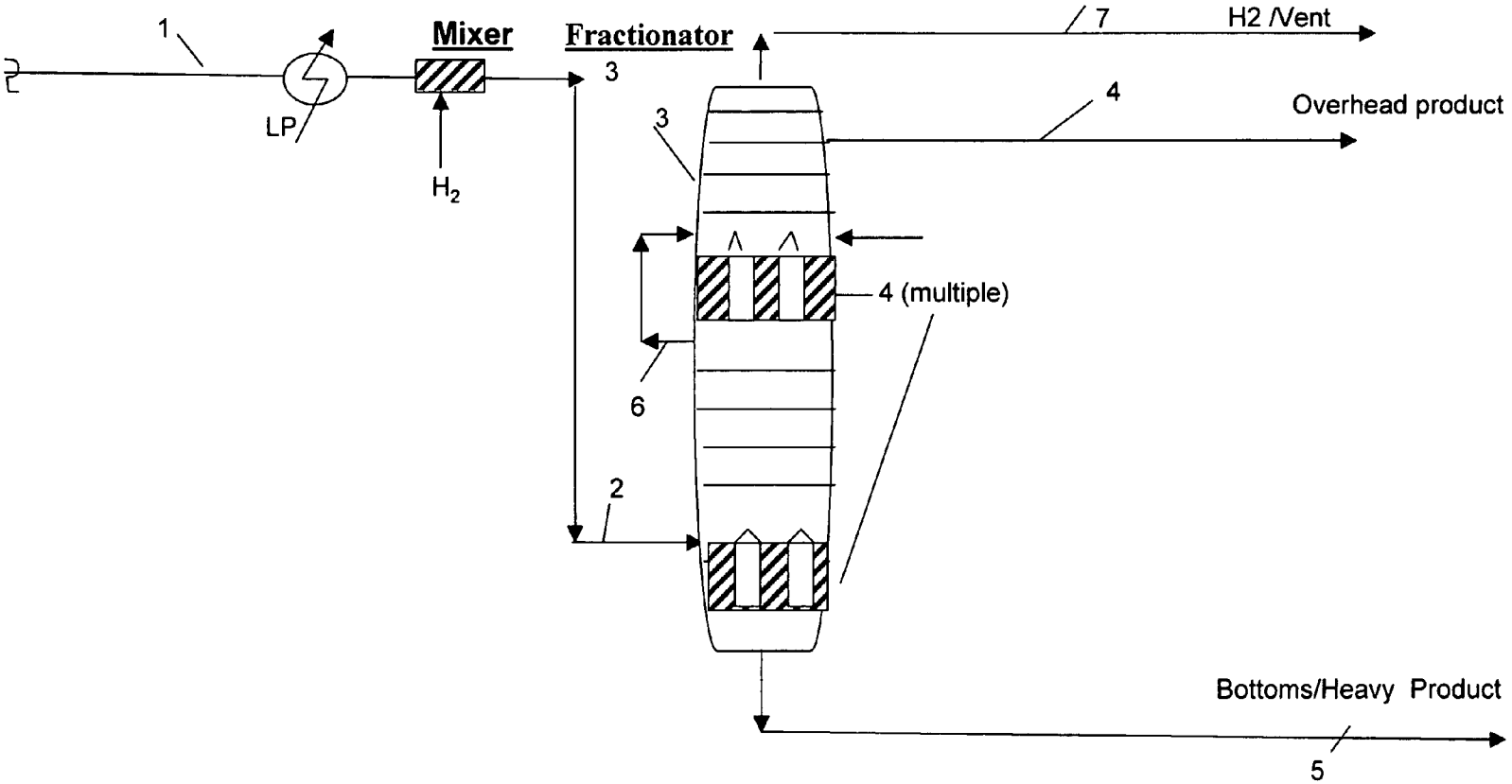
FIG. 5 is a simplified flow diagram for a third embodiment applied essentially for $C_3$ to C, hydrocarbons.

FIGS. 3, 4 and 5 are for applications, applied essentially for $C_3$ to $C_7$ hydrocarbons SHU application including benzene hydrogenation to cyclohexane to meet the product specifications. Essentially FIGS. 3, 4 and 5 are for same application except that FIG. 4 provides enhanced conversion with multistage reactor system and FIG. 5 is variation of same application using bulk catalyst installed in the column where the unit works as reactive distillation as alternate stages of reaction and distillation rather than simultaneous reaction distillation.

FIG. 3 description. The feed with vinylacetylenes, Propadiene and butadiens (diolefins,) or LCN or reformate is fed to the unit in FIG. 3, as stream 1, which is heated with product stream 5 and additional heat source (steam) and is fed to the Fractionator item 3, as stream 2. The components that are to be treated are taken as side draw from the fractionator item 3 as stream 6, and are collected in the drum item 7. There could be single or multiple side draws depending on the product requirements and severity so as to meet the specification and also it helps the selectivity by not pushing the reaction too far in one reactor item 8. The side draw from the fractionator item 3 stream 6 goes to from the drum item 7 is further pumped to the reactor item 8 (if required it be heated especially at the end of run condition) after mixing with hydrogen. Hydrogen is added at the pump discharge and is at least 120% of the stoichiometric requirements for hydrogenation to olefin and/or saturation as the case may be. The reactor item 8 is filled with catalysts depending on the application, Pd, Pd/Pt, Pd/Ag, Ni, Ni/Mo, Ni/W or Pt on Zeolite for the specific application. The reactor effluent is sent back to the fractionator for separation at the tray below from where the side draw stream 6 was withdrawn. Part of the reactor item 8 effluent is cooled and is sent to the drum item 7 so as to provide heat sink for heat of reaction generated in the process (SHU/benzene saturation or desulfurization). The overhead product stream 4, is taken as side draw from the fractionator item 3 meeting the product specification and lights/hydrogen is sent from the fractionator overhead to the fuel gas system. The bottom is separated and is cooled and sent to battery limit as stream 5 either as a product or for further treatment based on feed requirements especially in the case of Naphtha. As is obvious from the configuration, FIGS. 4 and 5 are extension of FIG. 3.

FIG. 4 description. FIG. 4 has multiple reactors item 8 with multistage operation, which provides better selectivity and meets any stringent specification for the product. This provides the best option for alpha to beta isomerization, as each stage provides an equilibrium stage after separation. Essentially FIG. 3 is applicable with all the streams and items except additional reactor item 8 has been added and these could be multiple stages of reactor to meet the product requirements. One might note here the RHT configuration in FIGS. 3,4 and 5 are much efficient compared to Reactive distillation or conventional Fixed bed processes. RHT process, in the case of isomerization provides equilibrium compositions and the feed to reactor is taken where maximum amount of species which needs to be converted, providing much lower capital investment in catalyst cost and column height as well. It is quite obvious to the person familiar with chemical equilibrium/thermodynamics that in reactive distillation application the composition is in thermal equilibrium at that temperature at each fractional packing space. If it cannot be separated in fractional packing it will be in equilibrium in the packing until it has separated. It is very obvious that isomers with low boiling point differences take much more mass transfer capability to separate hence the isomer equilibrium does not change and is a very inefficient operation.

FIG. 5 description. FIG. 5 is performing the same functions as FIGS. 3 and 4 but with different equipment and mode. Stream 1 of $C_2$ to Naphtha or reformate is heated mixed with required hydrogen and is fed to item 3 the fractionator as stream 2. The multiple bed of bulk catalyst item 4, are installed in the column with Chimney trays or external pipe which bypasses the catalyst as stream 6 so that essentially all the liquid is reacted in the catalyst beds item 4 in the fractionator at the locations where reaction is required for different application and based on severity to meet the specification for Stream 4 overhead product and bottom/heavy product stream 5. The vent is taken as stream 7 as shown in this FIG. 5.

The art of RHT process in FIGS. 3, 4 and 5, provides the best conditions for separation and reaction, and are decoupled for pressure and temperature so as meet the optimum conditions for the each process and still tied to the column so as to reduce the equipment piece count reducing the capital cost and providing the optimum yield and selectivity with standard low cost catalyst rather than expensive and catalyst, which requires cumbersome loading requirements. In the case of Benzene and LCN, fractionation can be operated at lowest possible pressure which helps the separation efficiency and also needs low level heat for reboiler, which is big saving and selectivity and yield are much better than the other processes available in market. The FIG. 5 provides bulk catalyst installation in the column to perform the same reaction in multiple beds and is cost effective where reaction and distillation can be done at optimum conditions.

Figure 6:
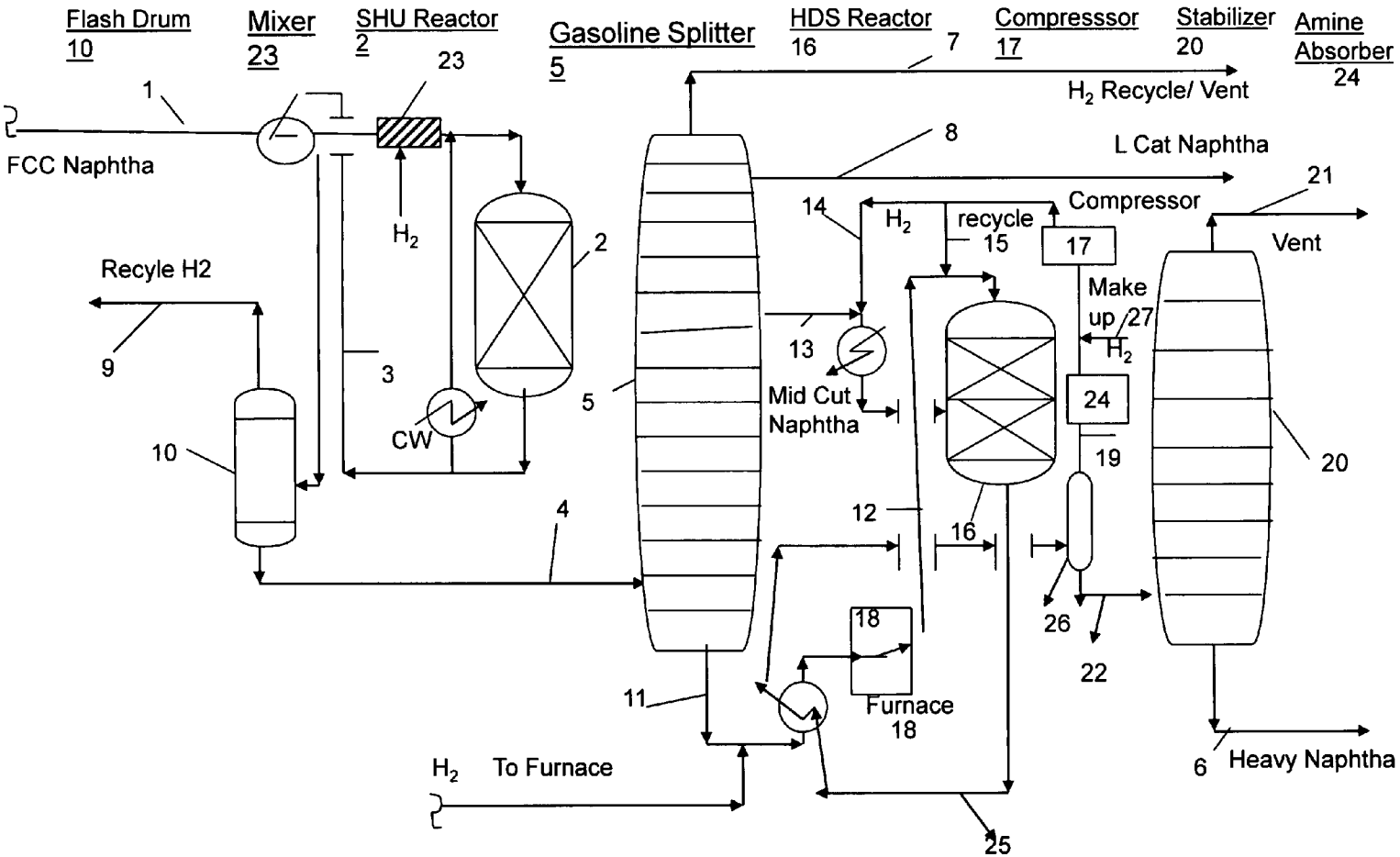
FIG. 6 is a simplified flow diagram for a fourth embodiment applied essentially for $C_3$ to $C_7$ hydrocarbons.
Figure 7:
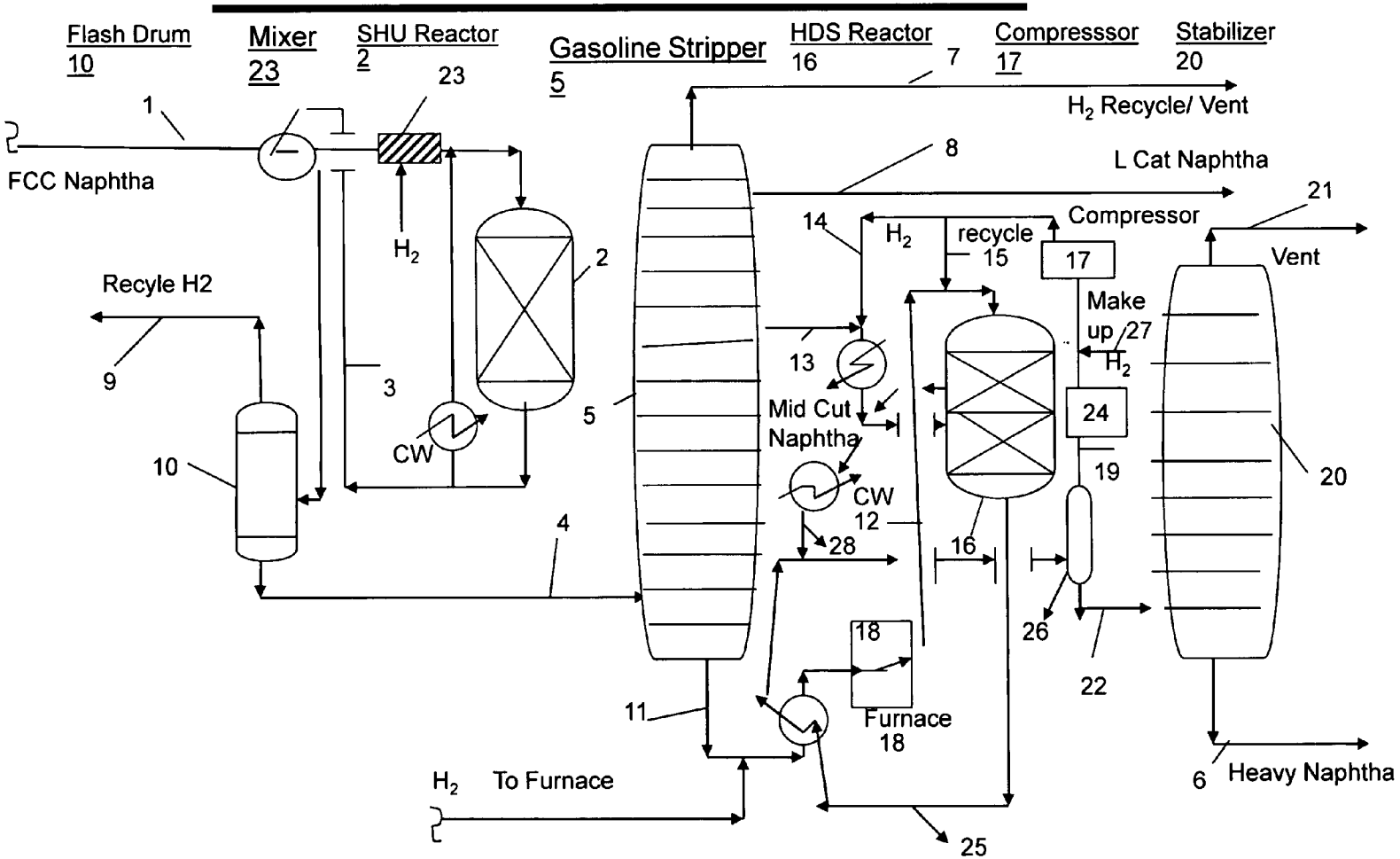
FIG. 7 is a simplified flow diagram for a fifth embodiment applied essentially for $C_3$ to $C_7$ hydrocarbons.

FIGS. 6 and 7 provide the art used by RHT for FCC gasoline HDS that contributes most of sulfur (90% from FCC gasoline) to the gasoline pool. So it is obvious by treating the FCC gasoline for sulfur removal, the gasoline pool sulfur will essentially meet the gasoline pool product sulfur specifications. USA and Europe has mandated that the gasoline pool specification has to meet sulfur specifications of 30 wppm and 50 wppm (recommended 10 wppm for Europe). Some of the Far Eastern countries are already following European specification but emerging markets are lagging behind for the present. As we can see that first part of this FIGS. 6 and 7 has already been described in FIG. 1.

FIG. 6 description. In FIG. 6 Feed stream of full Naphtha, stream 1 is heated mixed with hydrogen in inline mixer item 23 and cooled recycle is added to provide heat sink for the heat of reaction and is sent the reactor item 2 where the diolefins and mercaptan sulfur is removed. The reactor item 2 effluent stream 3 is cooled and is flashed in item 10 and liquid stream 4 which is Naphtha is sent to fractionator item 5 for separation. The vent from the flash drum stream 9 is recycled as hydrogen stream after compression to the reactor item 2. From Item 5 fractionator the overhead from top is vent stream 7 which is sent to fuel gas system. The topside draw is taken from item 5 fractionator as stream 8 as L Cat Naphtha product, which is sent to gasoline pool, and has less than 5 wppm sulfur meeting the sulfur specification for gasoline pool. This operation is similar to the operation in FIGS. 1,3, 4 and 5. This reaction and separation is done essentially to meet the sulfur specifications of the LCN. The mercaptan sulfur is converted to heavy sulfur compounds, which are taken with the bottom in the gasoline splitter item 5 in stream 11. The overhead product meets the gasoline specifications. Though depending on the feed characteristics, RHT technology provides the best option with Ni/Mo catalyst and operation at mild HDS conditions, at high space velocity so that the less refractory sulfur is desulfurized at minimal octane loss and enhance the LCN recovery overhead meeting the product specifications. This application with this catalyst and configuration will get some of the advantages of alpha to beta isomerization reaction for the $C_5$, $C_6$ and $C_7$ olefins in LCN. This normally provides small advantage (could be octane gain 0.2 of (R+M)/2, mostly in RON) and it is in the accuracy off engine test. It has been touted as a major advantage by some technologies at a cost of expensive catalyst (Pd) to no major advantage in comparison to the catalyst cost. The catalyst is not really effective if one is taking high sulfur content in LCN in 30 to 50 wppm. The stream 11 from item 5 fractionator bottoms is mixed with hydrogen, heated in the exchanger with reactor item 16 product and is heated in Furnace item 18 where it is heated to reactor inlet temperature of 650 to 750 F. The stream 12 from the Furnace item 18 is fed to the reactor item 16 after mixing with the recycle hydrogen stream 15, which is enhanced in pressure by the compressor item 17. The reactor item 16 is also fed with another Stream 13, which is taken from item 5 as side draw and is heated to the reactor temperature and is fed at the appropriate location for desulfurization so that it has enough catalyst quantity so as to provide adequate WHSV for desulfurization. The side draw stream 13 is provided with adequate catalyst higher WHSV in the reactor item 16 which is based on the feed stream 1 and side draw stream 13 properties which is essentially sulfur and olefins. The reactor item 16 effluent product stream 25 after heating the stream 11 in the exchanger is flashed in item 26 flash drum. The bottom from the item 26 flash drum stream 22 is fed to the item 20 the heavy Naphtha stabilizer where light ends are removed from the Naphtha (to meet the RVP required) as overhead, stream 21 and is sent to the fuel gas system and provide the RVP required for the heavy Naphtha as the product which s taken as bottom product stream item 6. The flashed vapor which is essentially hydrogen and some light ends are taken as stream 19 from the item 26. This hydrogen stream 19 is sent to amine absorber item 24 which removes $H_2S$ from this stream and this recycle hydrogen stream is mixed with make up hydrogen stream 27 and is sent to compressor item 17 and is divided in to two streams, stream 15 is mixed with the hydrocarbon feed stream 12 and is sent to the reactor item 16. Other part of the hydrogen stream 14 is mixed with the side draw stream 13 which is mid cut Naphtha and is heated and fed to the desulfurization reactor item 16 into the second bed or lower depending on the catalyst beds being installed as required by the feed and product specifications. By providing the maximum catalyst quantity and low WHSV from the feed stream 12 and less catalyst and high WHSV for stream 13 provides the optimum conditions so as to reduce the octane loss which is to be preserved.

FIGS. 6 and 7 are similar except that configuration of FIG. 7 provides option to take vapor stream 28 out and condense it and either take it as product or send it back to reactor item 16 after flashing the hydrogen in item 26, vapor is hydrogen with light ends and s recycled to reactor item 16 after $H_2S$ removal in amine absorber.

FIG. 7 description is similar to FIG. 6 and has been described but some of it is again described but as it has been described in detail it is summarized here. The feed stream 1, is heated and mixed with hydrogen in-line Mixer item 23, and is fed to the reactor item 2. Where based on feed characteristics it is selectively hydrogenated and mercaptan sulfur is converted to heavier sulfur or desulfurized at high space velocity in the presence of Ni/Mo, Ni, Pd or other catalyst mentioned above at 300 to 500 F temperature and 200 to 450 psig pressure. The Hydrogen is in the range 25 to 150 scf/bbl of feed. The reactor effluent stream 3 is used to heat the feed stream 1, and after that is flashed in item 10, where flashed hydrogen is either recycled or sent to fuel gas system based on the hydrogen feed rate. The stream 4 from item 10 is heated to Gasoline splitter temperature and is fed to item 5. The dissolved hydrogen is taken as vent with light ends as stream 7 and LCN stream 8, is taken as side draw from the few trays from the top. The bottom and side draws are taken as stream 11 and 13 respectively. The stream 11 is mixed with hydrogen 300 to 400 scf/bbl of feed and heated in the furnace to about 550 to 650 F temperature and mixed with recycle hydrogen upstream of the furnace or down stream and fed to the HDS reactor item 16. Reactor has desulfurization catalyst, Co/Mo, which desulfurizes the HCN. The MCN is mixed with hydrogen 200 to 400 scf/bbl of liquid and is fed to reactor to the second or third bed (as reactor could have multiple beds) either as is or after heating to 500 F temperature. The reactor effluent after heat exchanging with the reactor feed and cooling to 100 F is sent to the flash drum where hydrogen is flashed with light ends and Gasoline after desulfurization is sent the gasoline stabilizer item 20. The vent of light ends and $H_2S$ is taken as overhead stream 21 from the stabilizer and gasoline is taken as stream 6 meeting the gasoline specifications for sulfur. The Gasoline splitter is designed to take a side draw of mid cut Naphtha, the bottom heavy naphtha stream 11 has the maximum sulfur. Stream 11 is pumped to 250 to 450 psig range and after mixing with recycle hydrogen is heated to the 550 F to 600 F in the Furnace item 18 and is fed to the HDS reactor item 16 as a stream 12, which is mixed with some more recycle hydrogen, so as to have a partial pressures of hydrogen of about 200 to 300 psig depending on the reactor operating pressure. Stream 12 is provided with an overall space velocity of 3 to 6 depending on the sulfur content. The side draw stream 13 is mixed with the recycle hydrogen stream 14 and is heated to the reaction temperature of about 500 F and is fed to the reactor so as to provide a space velocity off 4 to 8 preferably 6. This scheme provides the most optimum scheme for low cost, simple control, and stable operating scheme with very high selectivity providing lowest octane loss and enhanced catalyst life. The reactor effluent after heat exchange and cooling is flashed. The liquid is sent to stabilizer, where gasoline is stabilized and sent to storage stream 6, the vent stream 21, is sent to Fuel gas after Removal of $H_2S$ or to FCC wet gas compressor. The vapor stream 19 from the flash drum is sent to amine absorber item 23, where $H_2S$ is removed from recycle hydrogen and light hydrocarbons. This stream is mixed with fresh make up hydrogen, and is compressed before sending to reactor, to furnace and side draw stream. RHT configuration with superior configuration at front end is able to recover most of the olefins as LCN in the gasoline stripper. The HDS for the stream that has the most of the sulfur is desulfurized under most severe conditions and as it is heavy with low olefin content, the octane loss is reduced. The side draw is sent to the HDS reactor so as to provide high space velocity reducing octane loss in this stream as well. Additionally, selection of dual catalyst system in for the HDS reactor and Selective hydrogenation Reactor unit (SHU), mercaptan and other lighter sulfur removal provide the best advantages at low cost and highest selectivity. The hydrogen is added to the SHU in the range of 30 to 140 scf/bbl of feed based on the catalyst selection. For HDS reactor (both feeds), the hydrogen is kept at 200 to 800 scf./bbl of the feed, preferably 450 scf/bbl. RHT provides low cost highly selective technology for FCC gasoline HDS, and without using any complex heat integration which effects the operability of the unit and also there is no proprietary catalyst used which has other major disadvantages. RHT technology can handle LCN. Without using complicated scheme, and can provide better selectivity with the optimum configuration. Some of the technologies provide carrier, and lot of additional equipment which increases the cost and tremendously and seems to be of no real advantage. Even if one uses two reactors for catalyst life with dual catalyst system, and optimum configuration the capital cost, selectivity and operating costs are lower. This avoids the complex configuration and material from other units as carrier, which is expensive and cumbersome configuration to say the least. RHT provides better selectivity compared to conventional technologies or any other technology available in the market. This application provides capability to take vapor out between the beds, cooled and liquid can be sent stabilizer or back to the reactor, where vapor goes to the recycle compressor for hydrogen recycle.

RHT has developed a HDS process, FIG. 8 for straight run distillate, LCO, Coker or any thermal cracker distillate. RHT configuration is unique as it claims that the HDS units can be directly tied to the Crude distillation Column, Vacuum Distillation units, Main Fractionator, Coker/Thermal cracker Fractionators at the pump arounds, side strippers, side-draw products, while these are hot and based on the sulfur the HDS unit distillate can be at higher pressure and cascaded to lower pressure for Naphtha with the hydrogen. In RHT scheme the hot feed from these locations (this is part of claim) Stream 1 or feed as available from the column is mixed with hydrogen stream 2, and heated with HDS reactor Feed/bottom exchanger by stream 4, before heating it further in the furnace item 5 and is fed stream 3 to the HDS reactor item 15. The stream 4 after heat exchange is flashed in HPHT flash item 6, the liquid stream 7 is fed to the stabilizer item 19. The vapor from HT Flash is further cooled and flashed in item 8 LT HP flash drum. The liquid from the flash stream 18 is fed to the stabilizer item 19. This process provides capability of LCO ring opening and hydrogenation so that cetane number improvement can be achieved.

The vapor from LTHP flash is amine washed in amine wash absorber item 9 so as to remove the $H_2S$ from the recycle hydrogen, and is mixed with fresh make up hydrogen and is compressed in recycle compressor item 10. The compressed hydrogen is mixed with the feed upstream of furnace as stream 13, and another part is sent as quench to the HDS reactor in between the beds so as to control the temperature rise in the reactor beds. The HDS reactor item 15 has multiple catalyst beds and could have different type of catalysts. The stabilizer item 19 stabilizes the distillate as stream 17 bottoms from the stabilizer and the overhead stream 16 is vent and wild naphtha and is sent to Naphtha stream in the refinery. This configuration is applicable to distillate, LCO and other thermal cracker distillate and kerosene stream with slight modification. The reactor works in 2500 to 450 psig ranges, depending on the feed cut point, quality and characteristics, and temperatures of 650 to 770 F temperature. The total hydrogen ranges from 800 to 12,000 scf/bbl of the feed to the reactor.

The major claim apart from improvements in reactor design and using multiple catalysts for desulfurization of the feed are as follows:

RHT technology and art of the process claims that feed could be pump around or side strippers/Side draws hot liquid and desulfurizing those separately in staged reactor system where hydrogen is cascaded. This scheme provides major advantages in heat/energy savings and essentially perform the desulfurization at different severity depended on the feeds characteristics.

The disclosed method and art can be understood by referring to the attached figures for the individuals who are familiar with the art, which are described in detail description of the figures herein. It should be understood that pipelines are in fact being designated when streams are identified and that stream are intended, if not stated when materials are mentioned. More over, flow control valves, temperature regulating and measuring devices, pumps, compressors, reboilers, condensers, coolers, heaters and drums and the like are understood as installed and operating in conventional relationships to the major items of equipment which are shown in the drawings and discussed hereinafter with reference to the continuously operating process of this invention and art—there in. All of these valves, devices, pumps, and compressors, as well as heat exchangers, accumulators, condensers and the like are included in the term auxiliary equipment. It is also understood that any of the equipment or reactors can be de-coupled by installing a drum in between two equipment items, so as to operate the these equipment at different conditions. It is an ability of ordinary skill in the art to implement such auxiliary equipment, as needed, in view of the present disclosure.

RHT is an emerging technology developer with a new and unique configuration, optimizing the conventional technology schemes, by reducing the equipment count by integrating the external reactor with the up stream column, this eliminates the need for stripper/stabilizer and associated equipment. This configuration allows reactors to be operated at optimum conditions, which enhances the selectivity. In isomerization of alpha to beta olefins or visa versa, and selective hydrogenation applications it provides optimum flow scheme with successive reactors to enhance the selectivity and can meet the product specifications to 10 wppm of diolefins. It provides similar approach for crude $C_4$'s from steam cracker with high content of diolefins to meet the low diolefin product as per the FIG. 2. The configuration in the FIG. 1, with the understanding so as to remove the mercaptan and lighter sulfur compounds are desulfurized and diolefins are also saturated to olefins, so that LCN recovery can be enhanced which reduces the octane loss of the FCC naphtha through the Naphtha hydrotreater in meeting the sulfur specification of the gasoline. This art of desulfurizing the FCC Light Cat Naphtha at high space velocity (5 to 20) is unique to the present art at mild hydrotreating conditions. By using this art, the bottom product is reduced in diolefins that enhances the catalyst life of the HDS reactor for heavier Naphtha desulfurization. The reactor operates at 100 to 450 psig and 100 to 600 F temperature and the fractionator operates at the lower pressure so that LCN can be condensed with air-cooling or water-cooling. The conditions are optimized to get the maximum LCN overhead with very low octane loss, which is measure of olefin saturation. This configuration provides the capability of performing the reaction and distillation at optimum conditions.

FIGS. 6 and 7 provides the configuration, which is essentially uses LCN treatment as suggested in FIG. 1, but then the Fractionator splits the rest of Naphtha into heavy and mid Naphtha which are desulfurized at two space velocities, with a provision to take part of the vapors out in between the catalyst beds, so as to reduce the sulfur in the HDS reactor item 16. The condensed liquid from this can be sent to stabilizer or recycled back to the HDS reactor. This Fractionator is optimized so those two products are taken to HDS reactor for desulfurization, the heavy and mid Cat naphtha under different space velocities. This optimum configuration is an enhancement of the process in reducing the octane loss. Proprietary catalyst is not being used which is a major cost and logistical benefit, and energy is not being wasted in increasing the catalyst bed temperature by taking most of the product in the overhead as practiced in certain technologies. Multiple beds with catalyst which provide best results for HDS and minimizes the recombination taking place is major advantage of the configuration. The HDS reactor operates at 200 to 450 psig and 450 to 750 F temperature with optimum dual catalyst.

RHT has developed an optimum configuration for MAPD. Acetylene, $C_3$ to LCN hydrocarbon stream, selective hydrogenation under optimum configuration with one or multiple side reactors so as to get the best selectivity. This configuration is also good for alpha to beta isomerization of $C_4$ to $C_7$ olefins, especially C4 olefins. The reactors operate at 100 to 450 psig and at temperature of 100 to 500 F, and optimized for each feed and service required by the process. This provides much better selectivity than conventional or other processes like Reactive distillation which keep the products at equilibrium in the catalyst zone in isomerization reactions and if the close boilers are to isomerized, lot of catalyst will be required.

The configuration for HDS of straight run Naphtha, Kerosene and distillate is provided with classical multiple catalyst system approach so to perform the denitrification, desulfurization of the feed. The unique art is suggested here in taking the feed to HDS unit directly from the pump-arounds in a Crude/Vacuum distillation columns, the side strippers, Main Fractionator side draws, or Fractionators in the thermal crackers units, so as to save energy. This provides major savings in the Furnace as the feed is already close to the HDS reactor temperature. By using this technique provides major advantage in having the reactors operate at the desired partial pressures and the hydrogen can be staged from high pressure reactor to lower pressure HDS reactor. No doubt there could be equipment piece count has increased by the having HDS reactor for different feeds but as they are at different pressure and cascading hydrogen there are some savings in Capital and operating cost. The HDS reactor depending on the Feed characteristics could be 450 to 900 psig for the Diesel but would need higher pressure for the VGO with a high cut point Feed and high sulfur content and its refractoriness. This might need 1500 to 2000 psig or higher pressures for residue feeds, and temperatures of 700 to 750 F and hydrogen requirements for the unit could be 600 scf/bbl to 12000 scf/bbl. So depending on the feed. Based on the feed characteristics one can always cascade the hydrogen to the lower pressure reactors. The WHSV of 0.5 to 4.0 is expected in these applications.

Other embodiments of the invention will be apparent to those skilled in the art of Hydro-processing from the consideration of this specification mentioned above or from the practice of invention disclosed herein. It is intended that these specifications mentioned above be considered as exemplary only with the true scope of this invention being indicated by the following claims.

What is claimed is:

1. A process for the treatment of a full boiling range fluid cracked naphtha containing mercaptans, olefins, diolefins, acetylenes and MAPD comprising the steps of:

(a) feeding the full boiling range fluid cracked naphtha to a reactor containing a solid hydrogenation catalyst under conditions such as to keep the full boiling range fluid cracked naphtha in at least a partial liquid phase;

(b) concurrently feeding hydrogen at such a rate as required to support selective hydrogenation of said diolefins, acetylenes, and MAPD to mono olefins;

(c) reacting a portion of said diolefins with a portion of said mercaptans to form sulfides and selectively hydrogenating a portion of said acetylenes, MAPD and diolefins in the presence of said catalyst in said reactor;

(d) feeding the effluent from the reactor to a distillation column where the effluent in fractionated into a light fluid cracked naphtha having reduced mercaptans, acetylenes, MAPD and diolefins which is removed as overheads and a heavy fluid cracked naphtha containing the sulfides from step (c) is removed as a bottoms;

(e) withdrawing a mid cut fluid cracked naphtha from said distillation column as a side draw said mid cut fluid cracked naphtha containing mercaptans, thiophenes and sulfides from;

(f) feeding said bottoms and hydrogen to the top of a second hydrodesulfurization reactor containing a hydrodesulfurization catalyst;

(g) feeding hydrogen and said mid cut fluid cracked naphtha to said second hydrodesulfurization reactor at a point below the top of said hydrodesulfurization catalyst;

(h) reacting mercaptans, thiophenes, and sulfides with hydrogen to form hydrogen sulfide in said second hydrodesulfurization reactor; and (g) feeding the effluent from said second reactor to a second distillation column reactor wherein hydrogen sulfide is stripped from the product as overheads and a heavy fluid cracked naphtha is removed as a second bottoms.

2. A process for the treatment of a full boiling range fluid cracked naphtha containing mercaptans, olefins, diolefins, acetylenes and MAPD comprising the steps of:

(a) feeding the full boiling range fluid cracked naphtha to a reactor containing a solid hydrogenation catalyst under conditions such as to keep the full boiling range fluid cracked naphtha in at least a partial liquid phase;

(b) concurrently feeding hydrogen at such a rate as required to support selective hydrogenation of said diolefins, acetylenes, and MAPD to mono olefins;

(c) reacting a portion of said diolefins with a portion of said mercaptans to form sulfides and selectively hydrogenating a portion of said acetylenes, MAPD and diolefins in the presence of said catalyst in said reactor;

(d) feeding the effluent from the reactor to a distillation column where the effluent in fractionated into a light fluid cracked naphtha having reduced mercaptans, acetylenes, MAPD and diolefins which is removed as overheads and a heavy fluid cracked naphtha containing the sulfides from step (c) is removed as a bottoms;

(e) withdrawing a mid cut fluid cracked naphtha from said distillation column as a side draw said mid cut fluid cracked naphtha containing mercaptans, thiophenes and sulfides from;

(f) feeding said bottoms and hydrogen to the top of a second hydrodesulfurization reactor containing a hydrodesulfurization catalyst;

(g) feeding hydrogen and said mid cut fluid cracked naphtha to said second hydrodesulfurization reactor at a point below the top of said hydrodesulfurization catalyst;

(h) reacting mercaptans, thiophenes, and sulfides with hydrogen to form hydrogen sulfide in said second hydrodesulfurization reactor; and (g) feeding the effluent from said second reactor to a second distillation column reactor wherein hydrogen sulfide is stripped from the product as overheads and a heavy fluid cracked naphtha is removed as a second bottoms; and (h) flashing said effluent prior to feeding to the second distillation column.

* * * * *